United States Patent [19]

Plooy

[11] Patent Number: 4,921,510

[45] Date of Patent: May 1, 1990

[54] VACUUM CLEANER SYSTEM

[76] Inventor: Arnold Plooy, Chippendale, Sydney 2008, Australia

[21] Appl. No.: 355,098

[22] Filed: May 12, 1989

Related U.S. Application Data

[63] Continuation of Ser. No. 159,414, Feb. 19, 1988, abandoned, which is a continuation of Ser. No. 878,376, filed as PCT AU85/00241 on Oct. 2, 1985, published as WO86/01989 on Apr. 10, 1986, abandoned.

[30] Foreign Application Priority Data

| | | | |
|---|---|---|---|
| Oct. 3, 1984 | [AU] | Australia | PG7467 |
| Nov. 6, 1984 | [AU] | Australia | PG7996 |
| Mar. 25, 1985 | [AU] | Australia | PG9895 |

[51] Int. Cl.[5] ..... B01D 46/04

[52] U.S. Cl. ..... 55/288; 15/352; 55/302; 55/319; 55/334; 55/417; 55/429; 55/472; 55/DIG. 3

[58] Field of Search ..... 15/347, 352; 55/288, 55/302, 318–320, 334, 417, 429, 431, 472, DIG. 3, 366, 395, 428

[56] References Cited

U.S. PATENT DOCUMENTS

| | | | |
|---|---|---|---|
| 995,974 | 6/1911 | Lewis | 55/428 X |
| 2,253,698 | 8/1941 | Goldsmith, Jr. | 55/428 |
| 2,591,567 | 4/1952 | Lofgren et al. | 55/283 X |
| 2,714,426 | 8/1955 | White | 55/DIG. 3 |
| 2,842,225 | 7/1958 | Wahlborg | 55/DIG. 3 |
| 3,097,938 | 7/1963 | Weller | 55/302 |
| 3,343,344 | 9/1967 | Fairaizl et al. | 55/429 X |
| 3,543,325 | 12/1970 | Hamrick | 55/429 X |
| 3,653,190 | 4/1972 | Lee et al. | 55/429 X |
| 3,748,836 | 7/1973 | Bachle | 55/302 |
| 3,895,929 | 7/1975 | Jysky et al. | 55/429 X |
| 3,910,781 | 10/1975 | Bryant, Jr. | 55/429 X |
| 3,944,404 | 3/1976 | Andrasfalvy | 55/429 X |
| 4,113,454 | 9/1978 | Cvacho | 55/429 X |
| 4,329,161 | 5/1982 | Osborn | 55/472 X |
| 4,531,258 | 7/1985 | Spellman | 55/429 X |
| 4,581,050 | 4/1986 | Krantz | 55/429 X |

FOREIGN PATENT DOCUMENTS

| | | | |
|---|---|---|---|
| 1001465 | 1/1957 | Fed. Rep. of Germany | 55/302 |
| 764704 | 9/1980 | U.S.S.R. | 55/302 |
| 784897 | 12/1980 | U.S.S.R. | 55/302 |
| 358337 | 10/1931 | United Kingdom . | |
| 1443494 | 7/1976 | United Kingdom . | |

*Primary Examiner*—Robert Spitzer

*Attorney, Agent, or Firm*—Dressler, Goldsmith, Shore, Sutker & Milnamow, Ltd.

[57] ABSTRACT

A vacuum cleaning system having a receptacle of non-porous material, such as a plastics bag (65), adapted to safely receive and hold hazardous material such as asbestos fibre. Vacuum is applied by a fan (86) to a suction chamber (69) and then through a filter (71) to an intermediate chamber (63) and via a suction pipe (61) to the bag (65). Waste material is sucked into the bag through an inlet pipe (67). The filter is cleaned periodically by admitting atmospheric air through a pulse valve (74) causing an inrush of air through the filter (71) and into the bag (65), cleaning the filter and intermediate chamber (63).

7 Claims, 5 Drawing Sheets

VACUUM CLEANER SYSTEM

This application is a continuation of application Ser. No. 159,414, filed Feb. 19, 1988, now abandoned, which is a continuation of application Ser. No. 878,376, filed as PCT AU85/00241 on Oct. 21, 1985, published as WO86/01989 on Apr. 10, 1986, now abandoned.

TECHNICAL FIELD

This invention relates to a vacuum cleaner system and has been devised particularly though not solely for the cleaning of hazardous substances such as asbestos fibre.

BACKGROUND ART

Most vacuum cleaning systems commonly used for domestic or industrial cleaning incorporate either a tubular bag of air permeable material through which air is sucked laden with waste material until the bag is full and ready for disposal, or alternatively incorporate a large cannister through which air is sucked by way of a suction fan through a permeable filter. Both of these systems are unsuitable for the cleaning of hazardous materials such as asbestos fibre, as fine fibres or other small particles can pass through the bag or filter and into the atmosphere. Furthermore the emptying of conventional cleaners of the type described above is a messy operation which can also be extremely hazardous where dangerous materials are concerned It is therefore an object of the present invention to provide a vacuum cleaning system which will obviate or minimise the foregoing disadvantages in a simple yet effective manner, or which will at least provide the public with a useful choice.

DISCLOSURE OF INVENTION

Accordingly the invention may broadly be said to consist in a vacuum cleaning system comprising a receptacle of substantially non-porous material, a suction pipe communicating with the receptacle, an inlet pipe communicating with the receptacle, an intermediate chamber communicating with the suction pipe, a suction chamber communicating with the intermediate chamber by way of a filter, suction means arranged to apply suction to the suction chamber via a suction conduit, and a control valve arranged to admit atmospheric air into the suction chamber when actuated under predetermined conditions.

Preferably the control valve comprises a pulse air valve arranged to admit pulses of atmospheric air into the suction chamber upon actuation.

Preferably a suction valve is provided arranged to at least significantly reduce the cross-sectional area of the suction conduit in concert with actuation of the control valve.

Preferably the control valve comprises an outwardly opening disc valve comprising a disc positioned on a seat forming a closure to an opening from the atmosphere into the suction chamber, said control valve being provided with drive means arranged to oscillate the disc on and off its seat upon actuation of the control valve.

Preferably the drive means comprises a piston and cylinder assembly or the like located within the suction chamber and incorporating a free floating piston connected to the suction chamber side of the disc by a compression spring such that movement of the piston toward the disc compresses the spring applying a force to the disc tending to lift the disc from its seat, the cylinder on the compression spring side of the piston being open to the suction chamber and on the opposite side of the piston being sealed from the suction chamber and communicating with the atmosphere by way of a conduit.

Preferably the conduit incorporates a valve arranged to open upon actuation of the control valve.

Preferably the suction pipe extends upwardly from the receptacle.

Preferably the inlet pipe is coaxial with and/or branched from the suction pipe.

Preferably the receptacle comprises a flexible bag formed from non-permeable sheet plastic material, gathered at the neck about the lower end of the suction pipe.

In an alternative form of the invention the pulse air valve and the suction means are each mounted in interchangeable housings, each adapted to be inserted into an opening in the suction chamber. In this form of the invention the vacuum cleaning system described above is used as a "base unit" for the emptying of a number of auxiliary units which may be in the familiar back-pack configuration. Each auxiliary unit is provided with a suction means in an interchangeable housing, also adapted to be inserted into the opening in the suction chamber of the base unit. In use each auxiliary unit may be used for the collection of waste such as asbestos fibres, and returned to the base unit for emptying of the auxiliary unit. The emptying operation is inaugurated by placing the suction means from the auxiliary unit into the top of the suction chamber of the base unit, and inserting the pulse air valve from the base unit into the top of the auxiliary unit (in the position previously occupied by the suction means). An outlet in the bottom of the auxiliary unit is then connected to the inlet pipe of the base unit, and the suction means actuated to suck the waste material from the auxiliary unit into the base unit, and under the operation of the pulse air valve in the auxiliary unit, causing the filter in the auxiliary unit to be cleaned.

In the configuration mentioned immediately above, the filter in the base unit may be cleaned by inserting the pulse air valve in the suction chamber of the base unit, inserting the suction means into the auxiliary unit, and connecting the vacuum inlet hose of the auxiliary unit to the base unit so as to communicate with the exterior of the intermediate chamber. Operation of the suction means then causes air to be sucked from the intermediate chamber through the controlled passage therein causing suction to be applied to the suction chamber through the filter in the base unit, and hence causing operation of the pulse air valve, admitting pulses of air into the suction chamber and thence through the filter into the intermediate chamber, causing material clogging the filter to be discharged therefrom and to fall downwardly through the suction pipe into the receptacle bag.

BRIEF DESCRIPTION OF DRAWINGS

Notwithstanding any other forms that may fall within its scope, one preferred form of the invention and variations thereof will now be described, by way of example only, with reference to the accompanying drawings in which.

MODES FOR CARRYING OUT THE INVENTION

Figure 1:
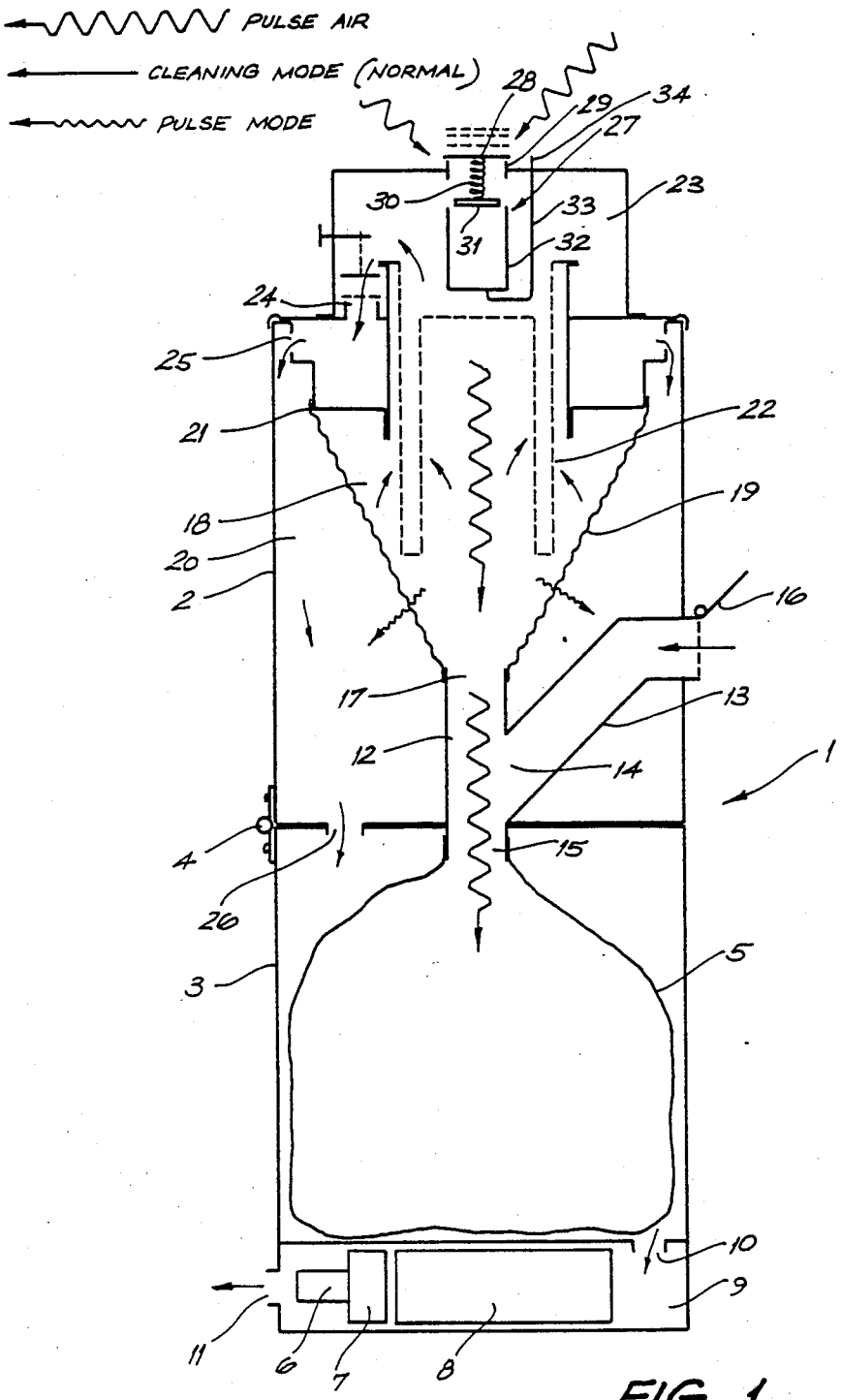
FIG. 1 is a diagrammatic cross-sectional elevation of one form of vacuum cleaning system according to the invention.

In one preferred form of the invention, as shown in FIG. 1, the vacuum cleaning system comprises a drum-like housing 1 which may typically be provided in an upper part 2 and a lower part 3 hinged together by way of a hinge connection 4. The lower part of the housing contains a receptacle of non-porous material which is preferably in the form of a flexible bag 5 manufactured from sheet plastics material. This bag may conveniently be a heavy duty garbage bag. The lower part of the housing is also provided with suction means in the form of an electric motor 6 driving a suction fan 7 through a final filter 8 so as to draw air into a lower chamber 9 through an opening 10 and discharge that air to the atmosphere through an outlet 11. Although the suction means is shown mounted in this location it can obviously be mounted in other locations on the housing as preferred.

The upper part of the housing is provided with a suction pipe 12 which extends upwardly from the receptacle 5 and communicate with the interior of the receptacle. The plastics bag 5 can be conveniently gathered around the lower end of the suction pipe 12 and secured thereto by a clamp, elastic band, or other convenient fixing means.

The vacuum cleaning system is further provided with an inlet pipe 13 which forms a Y-shaped branch at 14 with the suction pipe 12 so that material passing through the inlet pipe into the suction pipe is directed toward the lower or receptacle end 15 of the suction pipe. The inlet pipe protrudes upwardly and outwardly through the wall of the housing to be terminated by a spring loaded flap 16 which may be connected to an inlet hose in use.

The upper end 17 of the suction pipe 12 communicates with the interior of an intermediate chamber 18. The chamber is preferably formed so as to have a conical base 19 extending upwardly and outwardly from the upper end of the suction pipe, so that any material within the intermediate chamber can fall downwardly through the suction pipe into the receptacle 5. The intermediate chamber is provided with a controlled passage between the interior and the exterior thereof, i.e. from the interior 18 to the area 20 within the upper housing. This controlled passage may comprise apertures of a predetermined diameter formed in the intermediate chamber wall adjacent the upper end 21 or alternatively the wall of the intermediate chamber may be formed from the semi-permeable material such as Gore-Tex (Registered Trade Mark) which has a high resistance to the passage of air therethrough.

The upper end of the intermediate chamber is closed by way of a filter 22 which is preferably of a folded configuration as shown in FIG. 1 to give a large surface area. The resistance to air passage through the filter 22 is preferably lower than the resistance to air passage from the interior of the intermediate chamber 18 to the exterior 20.

Above the filter 22 there is provided a suction chamber 23 which communicates with the suction means 6,7 by way of a suction valve 24 and passages 25, 26 and 10. In this manner when the motor 6 is operated to drive the fan 7 air is sucked through the final filter 8 and passages 10, 26, 25 and 24, causing a reduced pressure in the suction chamber 23.

The suction chamber is also provided with a central valve in the form of a pulse air valve 27 comprising a large disc 28 seated on an opening 29 in the upper wall of the suction chamber. The disc is connected by way of a compression spring 30 to a piston 31 in a dash pot 32, which is sealed at its lower end apart from a valved air inlet conduit 33 communicating between the lower end of the dash pot and the atmosphere at outlet 34. The valve in the conduit is arranged to open upon actuation of the suction valve 24. In the preferred form of the invention the conduit 33 incorporates an adjustable restrictor which is operable to control the air flow rate through the conduit and hence to control the frequency of oscillation of the disc valve 28 during operation as described later.

In use the vacuum cleaning system is used to suck up waste material through the inlet pipe 13 to the bag receptacle 5 in the following manner. The inlet 16 is connected to a suitable nozzle, e.g. by way of a flexible hose in the well known manner. The motor 6 is then actuated causing air to be sucked from the suction chamber 23 as previously described. Air is accordingly drawn through the filter 22 from the suction pipe 12, and air is consequently drawn in through the inlet pipe 13. The reduced pressure in the lower part of the housing 3 causes the flexible bag 5 to inflate to the configuration shown in FIG. 1.

Waste material is drawn up by the air passing through the inlet pipe 13 and hence enters the suction pipe 12. The heavier waste material falls into the receptacle 5 due to the angle of the inlet pipe into the suction pipe, but some material may be carried upwardly into the intermediate chamber 18 where it adheres to the underside of the filter 22. Eventually the filter 22 becomes clogged to such a degree that the operation of the vacuum system becomes inefficient. When this happens the operator can close the valve 24 and flap 16 simultaneously opening the valve in conduit 34 causing the suction motor 6, 7 to draw air solely from the intermediate chamber 18 through the permeable wall thereof (or through the restricted openings in the upper end thereof). This suction is communicated through the filter 22 into the suction chamber 23 causing a reduction in pressure in the suction chamber which lifts the piston 31 within the dash pot 32 as the air pressure above the piston is considerably lower than the atmospheric air pressure below the piston. This movement of the piston causes the compression spring 30 to be compressed to a point where the upward force exerted on the disc 28 by the spring 30 is greater than the downward pressure from the atmosphere above, causing the disc to be lifted off its seat and a pulse of atmospheric air to be admitted to the suction chamber 23. This pulse of air rapidly increases the pressure within the suction chamber 23 allowing the piston 31 to descend in the dash pot 32 and close the valve 28 against its seat 29. The movement referred to above is repeated causing the disc valve 28 to oscillate upwardly and downwardly in a cylclic motion on its seat 29, admitting pulses of air into the suction chamber 23. These pulses of air pass downwardly through the filter 22 causing the waste material adhering thereto to be discharged and fall downwardly. Although the drive means for the pulse air disc valve has been described as a piston and cylinder assembly operating through a compression spring, it will be appreciated that any alternative form of mechanical drive means may be substituted for this assembly. The drive means could, for example, comprise an electric motor arranged to oscillate the disc via a cam or a crank drive. It is preferred however to utilise the piston and cylinder assembly described above as this makes use of the energy source available in the suction chamber to actuate the pulse air valve. Because the volume of the bag 5 (when "inflated") is greater than the volume of the intermediate chamber 18, both of which are under vacuum, there is a net movement of air from the filter 22 downwardly through the suction pipe 12 into the bag 5. This air movement directs the waste material from the filter into the bag 5 and also serves to clear any blockage in the suction pipe 12.

Once the receptacle bag is full it may be emptied simply by opening the two halves of the housing 2 and 3, tying off the upper end of the bag disconnecting the upper end of the bag from the lower end of the suction pipe 12, and removing the bag from the lower half of the housing 3. The bag, which is clean and impervious to the passage of any waste material may therefore be simply and cleanly removed for later disposal. The garbage bag may then be replaced by an empty clean bag and the cycle repeated as above.

Figure 2:
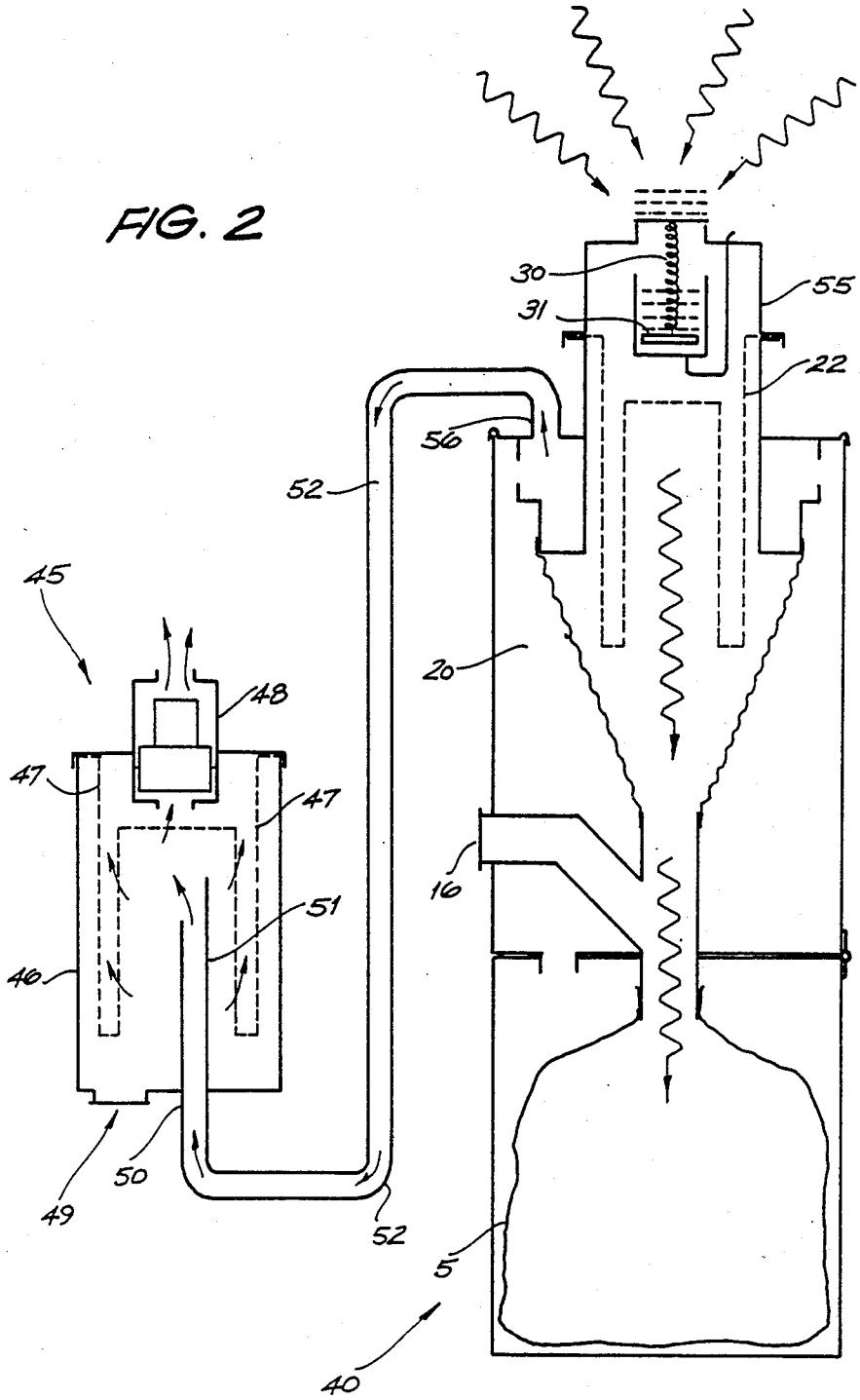
FIG. 2 is a diagrammatic cross-sectional elevation of an alternative form of the invention incorporating a base unit used in conjunction with one or more auxiliary units, and showing one auxiliary unit connected to the base unit for the cleaning of the main filter in the base unit.
Figure 3:
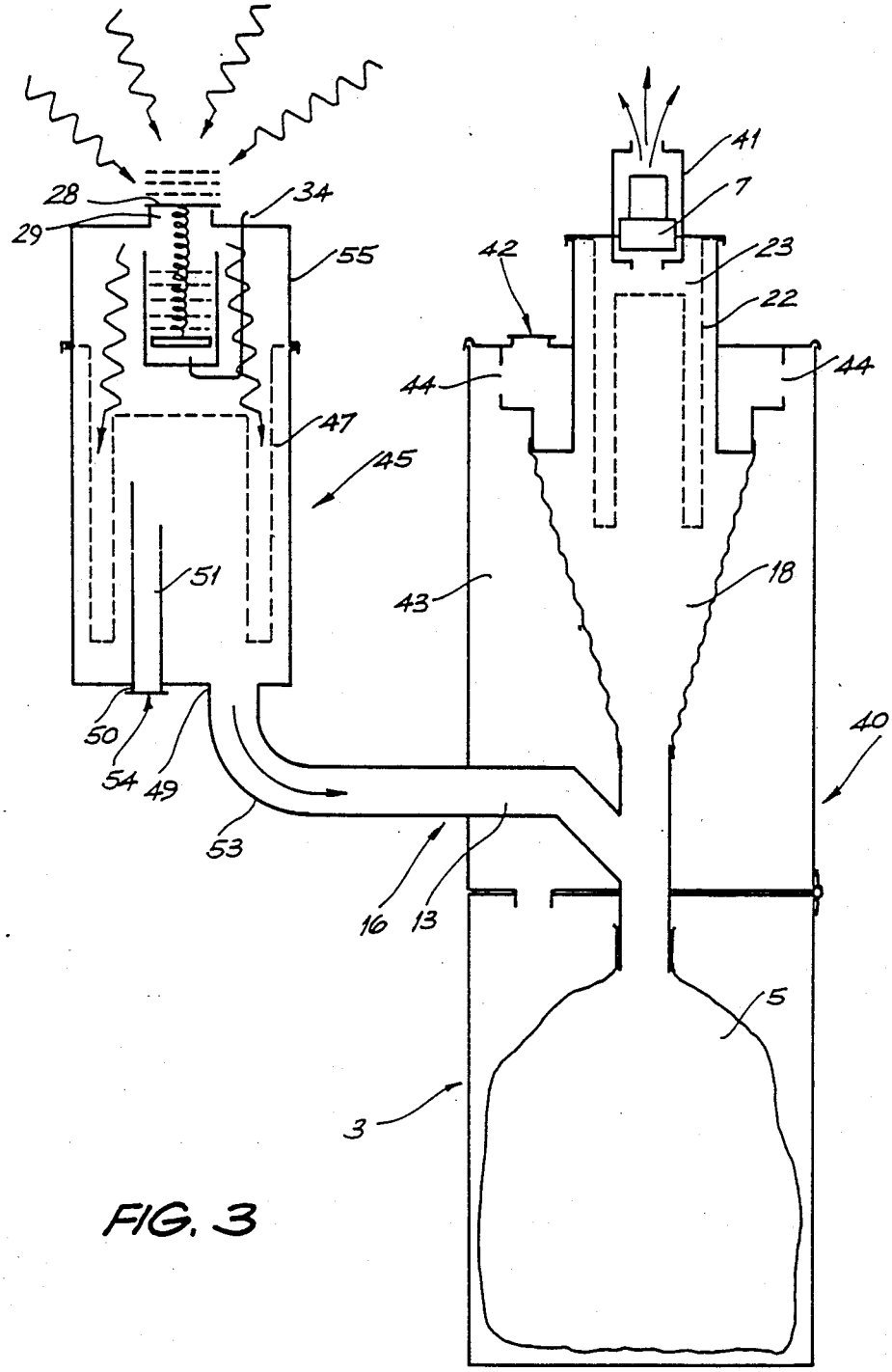
FIG. 3 is a diagrammatic cross-sectional elevation of the apparatus shown in FIG. 2 with the auxiliary unit connected to the base unit for the discharge of material from the auxiliary unit into the base unit, and the cleaning of the filter in the auxiliary unit.

In an alternative form of the invention as shown in FIGS. 2 and 3, the basic vacuum cleaning system may be provided as before as a base unit shown at 40, except that the suction motor and absolute filter are omitted from the bottom of the housing 1 and are replaced by a self-contained suction unit 41 located in place of the pulse air valve shown in FIG. 1. The base unit is also provided with a capped opening 42 which communicates with the interior of the housing 43 by way of an opening 44. Other features of the base unit 40 are as described for the unit shown in FIG. 1.

The base unit is adapted for use with a number of auxiliary units 45 which may for example be of the conventional and well known "back pack" configuration adapted to be used by operators in various diverse locations. Each back pack unit comprises a cannister 46 containing a filter 47 similar in configuration to the filter 22 shown in FIG. 1. Each auxiliary unit is provided with a removable suction unit 48 containing a motor and suction fan, identical to the suction unit shown at 41 in FIG. 3. The auxiliary unit further comprises a capped outlet 49 and an inlet 50 communicating with the interior of the cannister by way of a standpipe 51. The inlet 50 is connected to a hose 52, the remote end of which may be connected to a pick up nozzle as is commonly known in conventional vacuum cleaners.

In use the auxiliary unit 45 is used by an operator to collect waste material, which may be hazardous in nature, into the sealed interior of the cannister 46. When the cannister is full the operator returns to the base unit 40, whereupon the auxiliary unit is connected to the base unit for emptying as shown in FIG. 3. To empty the auxiliary unit the capped outlet 49 is connected to a waste pipe 53 which is in turn connected to the inlet pipe 13 in the base unit 40. The inlet 50 to the auxiliary unit is capped and sealed by way of a cap 54.

The suction unit 48 is removed from the auxiliary unit and becomes the suction unit 41 in the base unit 40. The pulse air valve 55 (similar in configuration and operation to the pulse air valve described above in connection with FIG. 1) has a similar mounting to the suction unit 41 or 48 and is inserted on the top of the auxiliary unit 45 as shown in FIG. 3.

Auxiliary unit 45 may be coupled to the base unit 40 by way of a quick connect fitting between the units which automatically closes the inlet 54 into the auxiliary unit upon engagement with the base unit and wherein the opening 49 into the auxiliary is provided with a disc valve which is caused to automatically open into the waste pipe 53 when the first pulse of air is admitted into the auxiliary unit 45 through the pulse air valve 29. The disc valve in the opening 49 is arranged to automatically close when the auxiliary unit 45 is removed from the base unit 40.

To empty the auxiliary unit into the base unit, the suction unit 41 is operated causing a suction to be applied to the interior of the auxiliary unit 45, actuating the pulse air valve 55 and causing air to be sucked from the pulse air valve, through the filter 22 into the suction chamber 23, drawing the waste material from the auxiliary unit 45 through the inlet pipe 13 and into the receptacle bag 5 in a similar manner to the operation of the unit described in connection with FIG. 1. This operation also serves to clean the filter 47 in the auxiliary unit in a similar manner to the cleaning of the filter in the base unit previously described with reference to FIG. 1.

A large number of auxiliary units may be emptied into the base unit 40 in this manner, without there being any contact by the operator with the contents of the auxiliary unit or the base unit.

When it is desired to clean the base unit filter 22, the auxiliary unit is connected to the base unit as shown in FIG. 2 with the suction unit 48 remaining in place on the auxiliary unit 45, and the pulse air valve 55 being mounted on the upper part of the base unit in a similar configuration to that previously described with reference to FIG. 1. The inlet hose 52 of the auxiliary unit is connected to inlet 56 in the base unit causing suction to be applied to the interior of the housing 20. This suction causes operation of the pulse air valve and cleaning of the filter 22 in a similar manner as described for filter cleaning with previous reference to FIG. 1.

In this manner a base unit may be provided with a single pulse air valve 55, and a number of auxiliary units 45 each provided with a suction unit 48, the roles of the suction unit and pulse air valve being interchanged as necessary for the emptying of each auxiliary unit in turn.

Furthermore the system may be operated with the base unit 40 at a central headquarters and a number of auxiliary units 45 used in satellite operations, each auxiliary unit sharing a common suction unit 48 which is changed from cannister to cannister as the cannister of each auxiliary unit becomes full.

An alternative form of the vacuum cleaning system to that shown in FIG. 1 will now be described with reference to FIGS. 4 and 5 which show a further embodiment of the invention adapted to be housed within a conventional drum container 60. The suction pipe 61 is supported from a funnel shaped member 62 forming the lower wall of the intermediate chamber 63, which is supported in turn by the rim 64 of the drum 60. The receptacle is once again formed from a flexible bag of non-permeable sheet plastics material 65 which is gathered at the neck 66 and secured about the lower end of the suction pipe 61. The inner end of the inlet pipe 67 is formed coaxially with the suction pipe 61 such that it extends upwardly into the intermediate chamber 63 before turning and extending out through the side to provide an inlet 68 which may be attached to a flexible hose.

Both the intermediate chamber 63 and the suction chamber 69 are located within an upper housing 70 engaged with the rim 64 of the drum 60, and separated by a pleated filter 71. The filter is circular in plan view as shown in FIG. 5 with a plurality of radial pleats to increase the surface area of the filter material.

The control valve is located in the upper part of the housing 70 which may be raised in portion 72 to support the seat 73 for the disc valve, the seat conveniently being provided by an O-ring seal. Although the disc valve may comprise a simple disc as shown and described with reference to FIG. 1, it is also possible to provide a compound disc valve of the type shown in FIG. 4. In this configuration there is provided a primary disc 74 seated on an intermediate seat such as an O-ring seal 75 which is in turn seated on a secondary disc 76 located on the larger O-ring seal 73. The primary disc 74 is once again connected by way of a compression spring 77 to a piston 78 in a dash pot cylinder 79 located within the suction chamber 69. (Although the drive means for the control valve is described as being by way of a piston and cylinder assembly as shown in the drawings, it will be appreciated that other equivalents such as diaphragms or bellows could be substituted for the piston and cylinder assembly). The upper end 80 of the cylinder 79 is open to the suction chamber 69 and the lower end 81 is sealed apart from a communication with conduit 82 which communicates with the atmosphere at outlet 83. The conduit is provided with a valve actuable as will be described below.

Figure 4:
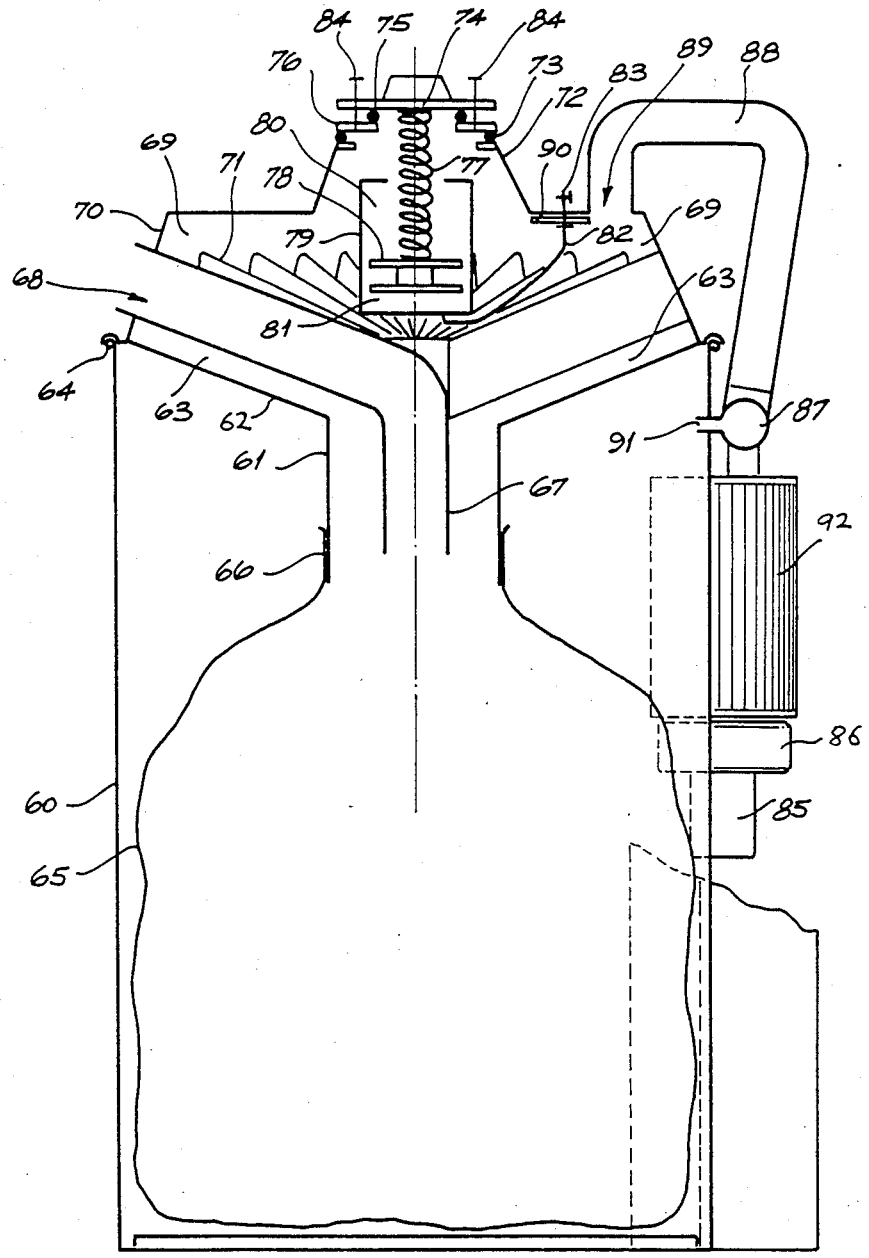
FIG. 4 is a cross-sectional elevation of an alternative form of vacuum cleaning system according to the invention.

The operation of the pulse air control valve shown in FIG. 4 is similar to that of the valve previously described with reference to FIG. 1 except for the two-stage operation of the disc valve. Once the valve in the conduit 82 is opened admitting atmospheric air into the lower end 81 of the cylinder 79 causing the piston 78 to rise within the cylinder and compress the spring 77, the upward force on the spring overcomes the downward force of atmospheric air against the primary disc 74 causing that disc to lift from its seat 75. The inrush of atmospheric air into the suction chamber 69 allows the primary disc 74 to lift further under the influence of spring 77 until the upper surface of the disc abuts the ends of hangers 84 protruding upwardly from the intermediate disc 76 through holes in the primary disc. The hangers are a sliding fit through the holes in the primary disc so that once the primary disc is elevated to a position where it abuts the end stops on the hangers 84, the upward movement of the primary disc causes upward movement of the intermediate disc 76 by way of the hangers 84, lifting the intermediate disc from its seat 73. In this manner a much larger opening, defined by the seat 73, is opened than that of the opening defined by the seat 75, permitting a much faster inrush of atmospheric air into the suction chamber 69. In this manner it is possible to provide a large opening defined by the seat 73, which is larger in area than that of the piston 78. Due to the two-phase opening of the disc valve the piston 78 is able to open the primary disc 74 which has a seat 75 smaller in area than the piston 78. It would of course not be possible for the piston 78 to open a single disc which had a seat larger in area than the piston.

Figure 5:
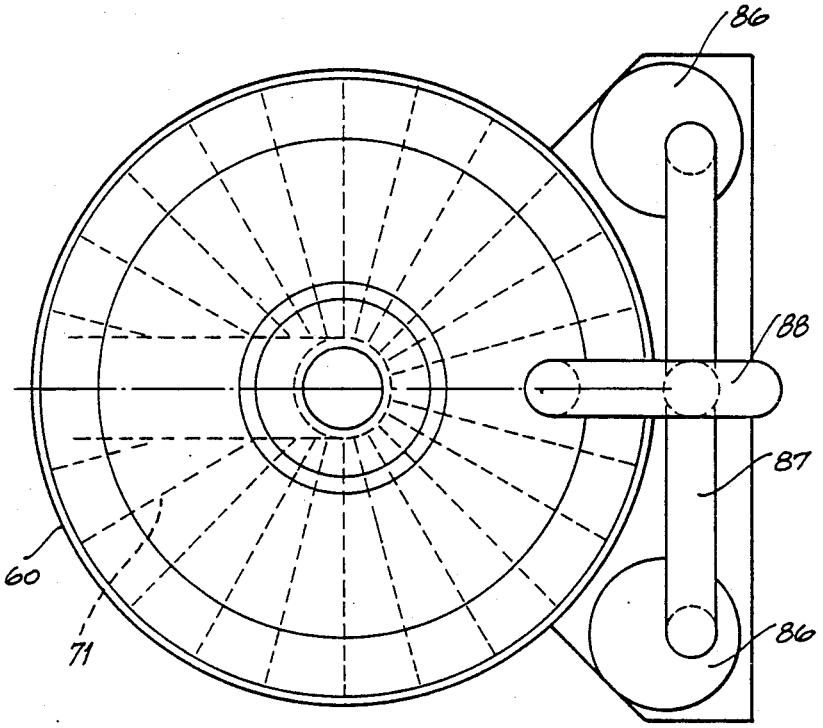
FIG. 5 is a plan view of the vacuum cleaning system shown in FIG. 4 with the upper part of the suction chamber and control valve omitted for clarity.

Suction is applied to the suction chamber 69 by way of suction means in the form of a motor 85 driving a suction fan 86 which may be a single fan motor unit or a dual motor unit as shown in FIG. 5 connected through a final filter 92 and a manifold 87 to a suction conduit 88. The suction conduit communicates with the suction chamber 69 by way of an opening 89 controlled by a sliding suction valve 90. The suction valve 90 is provided with a restricted opening therethrough such that when the valve is slid across the opening 89, the suction chamber 69 is isolated from the suction conduit 88 except for the small opening through the slide valve 90 through which suction is continued to be applied to the suction chamber 69. In this manner the opening in the slide valve 90 corresponds with the permeable nature of, or restricted opening in, the wall 19 of the intermediate chamber 18 of the embodiment shown in FIG. 1.

The sliding suction valve 90 is also arranged so that actuation of the suction valve causes the valve in the conduit 82 to open thereby actuating the pulse air control valve in concert with closing of the suction valve. At the same time opening 68 is closed, e.g. by a flap valve. The suction valve may either be manually operated or alternatively arranged to operate automatically when triggered by a pressure switch located in an appropriate location within the vacuum cleaning system. The pressure switch could, for example, be located in the intermediate chamber 63 or the suction chamber 69. The embodiment of the invention shown in FIG. 4 is also provided with a small passageway 91 between the manifold 87 and the interior of the drum 60 so as to apply a vacuum to the interior of the drum causing the flexible bag 65 to balloon out to an open position.

Operation of the vacuum cleaning system shown in FIGS. 4 and 5 is similar to that for the embodiment shown in FIG. 1. Normally the motor 85 is actuated applying suction to the suction chamber 69 through the open entrance 89 to the suction conduit 88. Suction is thereby applied through the filter 71 into the intermediate chamber 63 and hence through the suction pipe 61 into the receptacle 65. In this manner air and attendant particles are entrained through the opening 68 and downwardly through the inlet pipe 67 where the bulk of the entrained particles fall into the receptacle bag 65.

Some particles however are entrained upwardly onto the underside of the filter which ultimately becomes clogged. Once the filter becomes clogged the slide valve 90 is operated to significantly reduce the cross-sectional area of the suction conduit 88 while simultaneously opening the valve in the conduit 82 and closing inlet 68, actuating the pulse air control valve. Pulses of air are then admitted through the pulse air disc valve into the suction chamber 69 where they pulse through the filter 71 and downwardly through the suction pipe 61 into the receptacle bag 65. The pulses of air carry with them the particulate matter previously adhered to the undersurface of the filter 71, so cleaning the filter and allowing the suction operation to continue as before once the slide valve 70 is returned to the open position.

The unit shown in FIG. 4 may also be used to empty auxiliary units in the same manner as shown in FIG. 3.

In this manner a vacuum cleaning system is provided which enables the use of cheap disposable plastics garbage bags to be used as the eventual receptacle. The receptacle bags are used in such a manner that they never need to be discharged by opening to the atmosphere and therefore are perfectly safe for the collection of hazardous waste material such as asbestos fibre.

I claim:

1. A vacuum cleaning system comprising a flexible bag receptacle of substantially non-porous material having a neck of the bag gathered about a suction pipe communicating with the receptacle, an inlet pipe communicating with the receptacle, an intermediate chamber having a lesser volume than the capacity of the flexible bag receptacle communicating with the suction pipe, a suction chamber communicating with the intermediate chamber by way of a filter, suction means arranged to apply suction to the suction chamber via a suction conduit, and a control valve arranged to admit atmospheric air into the suction chamber when actuated under predetermined conditions to direct air through the filter, intermediate chamber, and into the receptacle to clean the filter and clear any blockage in the suction pipe.

2. A vacuum cleaning system as claimed in claim 1, wherein a suction valve is provided arranged to at least significantly reduce the cross-sectional area of the suction conduit in concert with actuation of the control valve.

3. A vacuum cleaning system as claimed in claim 2, wherein the control valve comprises a pulse air valve arranged to admit pulses of atmospheric air into the suction chamber upon actuation.

4. A vacuum cleaning system as claimed in claim 3, wherein the control valve comprises an outwardly opening disc valve comprising a disc positioned on a seat forming a closure to an opening from the atmosphere into the suction chamber, said control valve being provided with drive means arranged to oscillate the disc on and off its seat upon actuation of the control valve.

5. A vacuum cleaning system as claimed in claim 4, wherein the drive means comprises a piston and cylinder assembly located within the suction chamber and incorporating a free floating piston connected to the suction chamber side of the disc by a compression spring such that movement of the piston toward the disc compresses the spring applying a force to the disc tending to lift the disc from its seat, the cylinder on the compression spring side of the piston being open to the suction chamber and on the opposite side being sealed from the suction chamber and communicating with the atmosphere by way of a vent conduit.

6. A vacuum cleaning system as claimed in claim 5, wherein the conduit incorporates a valve arranged to open upon actuation of the suction valve.

7. A vacuum cleaning system as claimed in claim 1, wherein the suction pipe extends upwardly from the receptacle.

* * * * *